US009261094B2

(12) United States Patent
Hugenroth

(10) Patent No.: US 9,261,094 B2
(45) **Date of Patent: *Feb. 16, 2016**

(54) ROTARY COMPRESSOR

(71) Applicant: CAIRE Inc., Ball Ground, GA (US)

(72) Inventor: Jason James Hugenroth, Baton Rouge, LA (US)

(73) Assignee: Caire Inc., Ground Ball, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/303,800

(22) Filed: Jun. 13, 2014

(65) Prior Publication Data

US 2014/0294639 A1 Oct. 2, 2014

Related U.S. Application Data

(63) Continuation of application No. 12/879,998, filed on Sep. 10, 2010, now abandoned.

(60) Provisional application No. 61/241,331, filed on Sep. 10, 2009.

(51) Int. Cl.

| | |
|---|---|
| ***F01C 1/00*** | (2006.01) |
| ***F04C 18/356*** | (2006.01) |
| ***F04C 23/00*** | (2006.01) |

(Continued)

(52) U.S. Cl.

CPC ..... *F04C 29/02* (2013.01); *F01C 21/104* (2013.01); *F04C 18/322* (2013.01); *F04C 18/3564* (2013.01); *F04C 18/38* (2013.01); *F04C 23/001* (2013.01); *F04C 2230/91* (2013.01)

(58) Field of Classification Search

CPC B01D 53/047; B01D 53/0476; F01C 21/104; F04C 18/322; F04C 18/3564; F04C 18/38; F04C 23/001; F04C 29/02

USPC ..... 418/241, 63, 83, 64, 105, 138

See application file for complete search history.

(56) References Cited

U.S. PATENT DOCUMENTS

| | | | |
|---|---|---|---|
| 993,530 | A | 5/1911 | Kinney |
| 2,313,387 | A | 3/1943 | McArthur et al. |

(Continued)

FOREIGN PATENT DOCUMENTS

| | | | |
|---|---|---|---|
| EP | 1640611 | A1 | 3/2006 |
| EP | 1975412 | A2 | 10/2008 |

(Continued)

OTHER PUBLICATIONS

PCT International Search Report and Written Opinion dated Jun. 1, 2012, for PCT application No. PCT/US2010/048528.

*Primary Examiner* — Thai Ba Trieu
*Assistant Examiner* — Dapinder Singh
(74) *Attorney, Agent, or Firm* — Fred C. Hemandez; Mintz Levin Cohn Ferris Glovsky and Popeo, P.C.

(57) ABSTRACT

An aspect of the present disclosure involves a rotary compressor that is primarily optimized for use without the need for liquid lubricants, such as in the flow path of the fluid being compressed, and is efficient and quiet to use. The compressors described herein are efficient, run quietly, use less power, and last longer than those previously known in the art. The compressors are useful for medical applications and other clean gas applications, for instance, where lubricants could contaminate the fluid being compressed and/or increased noise and/or vibration may be problematic.

20 Claims, 13 Drawing Sheets

(51) Int. Cl.

| | |
|---|---|
| ***F04C 29/02*** | (2006.01) |
| ***F01C 21/10*** | (2006.01) |
| ***F04C 18/32*** | (2006.01) |
| ***F04C 18/38*** | (2006.01) |

(56) References Cited

U.S. PATENT DOCUMENTS

| | | | | | |
|---|---|---|---|---|---|
| 2,536,851 | A | * | 1/1951 | Latham, Jr. | 418/91 |
| 3,073,118 | A | * | 1/1963 | August | 123/213 |
| 3,102,516 | A | * | 9/1963 | Gist et al. | 418/83 |
| 3,279,442 | A | * | 10/1966 | Birk | 123/1 R |
| 3,521,981 | A | | 7/1970 | Krzyszczuk | |
| 3,769,944 | A | * | 11/1973 | Raymond | 123/235 |
| 2008/0107556 | A1 | * | 5/2008 | Bae et al. | 418/63 |
| 2008/0193314 | A1 | | 8/2008 | Cho et al. | |
| 2011/0058970 | A1 | | 3/2011 | Hugenroth | |

FOREIGN PATENT DOCUMENTS

| | | | |
|---|---|---|---|
| JP | 58085389 | A | 5/1983 |
| WO | WO-2009037968 | A1 | 3/2009 |

* cited by examiner

ROTARY COMPRESSOR

RELATED APPLICATIONS

This patent application is a continuation of U.S. patent application Ser. No. 12/879,998, entitled "Rotary Compressor and Method," and filed on Sep. 9, 2010, which claims priority under 35 U.S.C. §119(e) to U.S. Provisional Patent Application Ser. No. 61/241,331, entitled "Rotary Compressor and Method," and filed on Sep. 10, 2009. The contents of the above-referred patent applications are hereby incorporated by reference in their entireties.

TECHNICAL FIELD

The technology presented herein relates to rotary compressors.

BACKGROUND

U.S. Pat. No. 993,530 and U.S. Pat. No. 2,313,387 disclose rotary compressors. Compressors configured in this manner are commonly used as vacuum pumps and as refrigeration compressors. Liquid lubricants perform several functions within a compressor. Lubricants reduce the friction between contacting components that are in relative motion with respect to one another. This reduces frictional heating and wear. For instance, surrounding the compression space of a compressor small leakage paths exist between adjacent parts that allow compressed gas at a relatively high pressure to leak to low pressure areas. This reduces the efficiency of the compressor. Liquid lubricants are able to effectively seal these leakage paths, thus, increasing efficiency.

In addition, the specific thermal capacitance of liquids is much higher than that of gases. Therefore, relatively small amounts of liquid lubricant in the compression space are able to absorb a relatively large amount of heat. When a gas is compressed adiabatically a substantial temperature rise of the gas occurs. During operation of a lubricated compressor, liquid lubricant, in the compression space can absorb some of the heat-of-compression. This decreases the temperature rise of the gas being compressed. Since compression work is directly proportional to gas temperature, the efficiency of the compressor is improved.

Liquid lubricants can also bear substantial loads, such that parts that appear to contact are actually separated by a thin film of lubricant even when the force trying to bring the parts into contact is substantial. Gases, on the other hand, support relatively small loads due to their low viscosity and high compressibility. Gases also leak much more readily from very small clearances.

In view of the benefits attributed to liquid lubricants in compressors, it becomes difficult to design an oil-less compressor that is efficient, reliable and cost effective to manufacture. Additionally, typical compressors suffer from other deficiencies that make them inefficient and noisy, they require increased power, and are subject to wear. The rotary compressors described herein solve these and other such issues.

SUMMARY OF THE DISCLOSURE

An aspect of the present disclosure involves a rotary compressor that is primarily optimized for use without the need for liquid lubricants, such as in the flow path of the fluid being compressed. The compressors described herein are efficient, run quietly, use less power, and last longer than those previously known in the art. The compressors are useful for medical applications and other clean gas applications, for instance, where lubricants could contaminate the fluid being compressed and/or increased noise and/or vibration may be problematic. A specific example being medical respiratory applications, such as, pressure-swing-absorption and vacuum-pressure-swing-absorption oxygen concentrators. The usefulness of the compressors described herein is not limited to traditional clean gas applications. For example, the lubricating oil used in refrigeration compressors coats the inside surfaces of the heat exchangers in the refrigeration system. This reduces the effectiveness of the heat exchangers, which results in a decrease in system efficiency. Use of the disclosed compressor technology in refrigeration systems could improve the efficiency of these systems.

The present rotary compressor is efficient, reliable, and cost effective to produce. Various embodiments of the present disclosure permit the compressor to operate; without lubricating liquids, such as oil, on the surfaces contacted by the fluid being compressed or pumped; with reduced leakage; without contact between components or with reduced wear when contact does occur. Additional embodiments are provided so as to increase efficiency, decrease vibrational noise and power requirements and increase durability.

Accordingly, provided herein, in a first aspect, is a rotary compressor for processing a fluid, such as for use in a fluid concentrator or refrigeration system. The compressor includes a housing, e.g., a stator element. The housing includes a plurality of surfaces that are axially separated surfaces that bound a chamber. The chamber may have multiple portions therein. For instance, the chamber may have one, two, three, or more chamber portions. For example, one chamber portion may form a vane chamber, another portion may form a bushing chamber, and a further portion may form a cylinder chamber, e.g., a bore chamber portion. These chamber portions may be individual chamber portions, or in certain embodiments, the chamber portions may be combined with one another to form a combined chamber portion. For instance, in certain instances, the vane and bushing portions may be the same chamber portion. The housing itself is bounded. The housing may be bounded by one or a plurality of endplates, which endplate(s) may be disposed one on each of the axially separated surfaces of the housing thereby effectively sealing the chamber of the housing.

The housing may additionally include a cylindrical piston. In certain embodiments, the piston may have opposing surfaces and include an interior diameter and an exterior diameter. The piston may be operatively associated with a drive member, such as a shaft, magnetic coupling, or the like. The piston may be disposed within the cylinder chamber portion of the housing and rotatable therein. In certain embodiments, the piston may be offset with respect to a centerline of the cylinder chamber, e.g., bore chamber, portion, such that the outer diameter of the piston is in close proximity to the bounds of the cylinder chamber portion during rotation of the piston. For instance, where a shaft is included the piston may be offset with respect to a centrline of the shaft. Accordingly, the piston in its orbit therefore may divide the cylinder chamber portion into a suction chamber sub-portion and a compression chamber sub-portion. Additionally, in certain instances, the piston is further associated with a vane member.

The housing may further include an elongated vane member. The vane member may be an extended member having a proximal portion, e.g., associated with the piston, and a distal portion. The vane member may be slidingly disposed within the chamber such that as the piston orbits within the cylinder, e.g., bore, chamber portion, the distal portion of the vane member extends at least partially into the bushing chamber portion, and/or vane chamber portion, if included.

The housing may additionally include at least one bushing, rotatably disposed in the bushing chamber, and a drive member for driving the piston in a rotational motion such that as a volume of the suction chamber increases a volume of the compression chamber decreases. The drive member may be any suitable drive member, such as a shaft connected to a drive motor, a magnetic coupling, and the like.

In certain instances, a rotary compressor of the disclosure does not have a fluid lubricant other than the process fluid within contact of the chamber. For instance, for the purpose of increasing the efficiency of compressor function.

In other embodiments, the rotary compressor may include a vane chamber, such as a vane chamber that is in fluid communication with the cylinder chamber portion, for a first portion of the piston's orbit, and may further be isolated from the cylinder chamber portion, for a second portion of the piston orbit, so as to reduce compressor power consumption and limit wear.

In one instance, the piston and vane combination are balanced. The piston and vane combination are balanced when their composite center of mass is substantially coincident with the piston's orbit circle, wherein the orbit circle's center point is substantially coincident with the bore chamber centerline. In general, a cylindrical piston, separate from the vane, would be balanced. The presence of the vane on the piston makes the piston and vane combination unbalanced. The piston and vane combination are considered substantially balanced when at least a portion of the imbalance caused by the presence of the vane is reduced, i.e., when the root mean square of the perpendicular distance from the center of mass of the piston and vane combination to the orbit circle is reduced. For example, the piston may include a cutout portion, which cut out portion may form a chamber, which chamber may or may not be in communication with one or more of the bore chamber sub-chambers and/or a surface of one or more of the endplates.

In certain embodiments, a bushing chamber may be included wherein the bushing chamber includes one or more bushings, such as, wherein the one or more bushings are rotatably disposed within the bushing chamber and the vane is slidingly disposed between a slot formed by the bushing. Where a plurality of bushings are provided, at least one of the bushings may include a recess, such as a recess that allows communication between the vane chamber and one or more chambers of the bore chamber, e.g., the suction or compression chambers. One or more bushing bearings may also be present in the bushing chamber, such as between the bushing and the bushing chamber surface.

In certain embodiments, a dual cylinder rotary compressor is provided. The compressor may include a first housing having axially separated surfaces. The first housing may bound a chamber. The chamber may have multiple portions therein, such as portions that may include one or more of: a vane chamber portion, a bushing chamber portion, and a cylinder chamber portion. The compressor may additionally include a second housing having axially separated surfaces. The second housing may also bound a chamber. The chamber may have multiple portions therein, such as portions that may include one or more of: a vane chamber portion, a bushing chamber portion, and a cylinder chamber portion.

A plurality of endplates may also be included. The endplates may be disposed one on each of the axially separated surfaces of the housings thereby effectively sealing the chambers, wherein each housing shares at least one endplate. The shared endplate may have a generally axially aligned hole there through.

A drive mechanism, such as an elongated shaft may also be present and extend through the cylinder chamber portions of the first and second housings. The shaft may define a centerline therein and may be associated with a piston in each housing. A plurality of cylindrical pistons one of which is associated with the first housing another one of which is associated with the second housing may also be present.

The pistons may each have an interior diameter and an exterior diameter. They may be operatively associated with the drive mechanism, e.g., the shaft, the pistons being 180 degrees opposed to one another and offset from a centerline of the bore chamber such that the outer diameter of each piston is in close proximity to the bounds of the cylinder chamber portion of the housings, thereby dividing the cylinder chamber portions into a suction sub-chamber and a compression sub-chamber.

Each piston may further be associated with a vane member. Accordingly, a plurality of elongated vane members may be included. Each vane member may have a proximal portion that is associated with a respective piston and a distal portion, wherein each vane member is slidingly disposed within the respective chamber of the housings such that as the piston rotates within the cylinder chamber portion, the distal portion of the vane member extends at least partially into a bushing and/or vane chamber portion.

A plurality of bushings may also be included wherein the bushings may be rotatably disposed in each of the bushing chamber portions of the housings. The bushings may be configured such that the distal portion of each vane member is disposed between a slot formed by the bushings. The housings may additionally include a plurality of suction ports wherein each is in fluid communication with a suction chamber and/or a discharge port, such as in the compression chamber of each of the housings. A plurality of valve mechanisms for selectively controlling fluid communication between the compression chambers and the discharge ports may also be included.

A drive mechanism, such as a shaft coupled to a drive motor, for driving both of the pistons in a rotational motion may also be provided In certain instances, a cutout is provided wherein the cutout allows for fluid communication, such as from an interior to an exterior of a bearing. For instance, where a shaft is provided, the shaft may include a cutout where the cutout is configured for allowing fluid communication between proximal and distal portions of the shaft, such as proximal to one or more bearings. In other instances, such as where the shaft is configured for driving the piston in an orbital motion, the shaft may include a generally cylindrical eccentric member that is offset from a centerline of the shaft. The eccentric member may include one or more a bearings and therefore may be configured to include one or more cutout portions for allowing fluid communication between axial ends of the eccentric member, e.g., proximal to one or more of the bearings.

In certain instances, the dual cylinder rotary piston compressor of the disclosure does not have a fluid lubricant other than the process fluid within contact of either of the chambers. Further, each chamber may be in fluid communication with a pressure source.

Other and further aspects, objects, features, and advantages of the present disclosure will become better understood with the following detailed description of the accompanying drawings.

DETAILED DESCRIPTION OF THE DISCLOSURE

With reference to FIGS. 1-25*b*, multiple embodiments of a rotary compressor and method will be shown and described.

Figure 1:
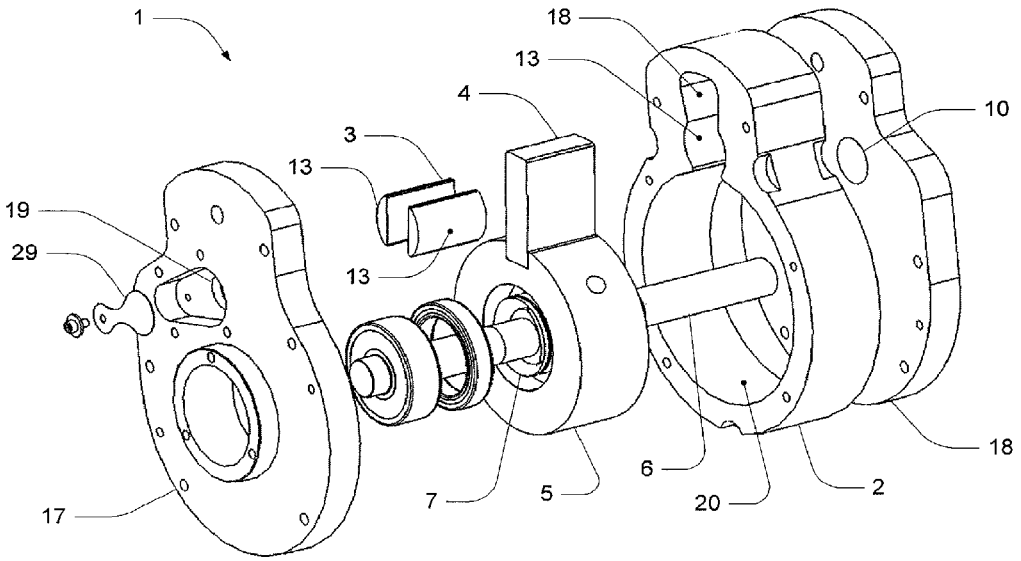
FIG. 1 is an exploded perspective view of an embodiment of a rotary compressor.

FIG. 1 shows an exploded view of a rotary compressor 1. An exemplary rotary compressor 1 of the disclosure includes several inter-related parts.

For instance, the compressor includes a housing. The housing may be formed as a stator 2 and may include two endplates, for instance, a discharge end plate 17 and a suction end plate 18. As depicted, the discharge end plate 17 includes a discharge port 19, and the suction endplate 18 includes a suction port 10. It is to be noted that although the discharge and suction ports are depicted herein as being associated with respective endplates, in other embodiments, one or both ports may be associated with a single endplate or other parts of the compressor housing. Also, it is to be noted that although the endplates are depicted as separate components from the housing, an endplate can be an integral part of the housing.

The stator 2 includes an outer perimeter surrounding a cavity. As depicted, the cavity includes three sections or chambers. A first chamber forms a vane chamber 8, wherein a vane 4 resides. A second chamber forms a bushing chamber 13 wherein bushings 3 reside. A third chamber 20 comprises a large cylinder or bore chamber that forms a suction and/or compression space volume wherein a piston 5 resides. It is to be noted that although three chambers are depicted, different configurations may be present. For instance, the vane and bushing chambers may be combined to form a single chamber. The stator 2 comprises opposing axial surfaces, such as a front and a back surface, each of which is associated with an end plate, e.g., 17 or 18, thereby enclosing the chamber space.

The vane 4 is an extended member, a portion of which is associated with the piston 5 and another portion of which extends into one or both of the bushing chamber 13 and vane chamber 8. In certain instances, the vane is integrally formed with the piston and in other instances the vane is detachably attached to the piston.

The bushing chamber 13 may include one or more bushings and a vane. It is to be noted that although two bushings are depicted, in certain instances, one or more than two bushings may be employed. The bushing(s) in this embodiment may be of any shape and design so long as they are capable of mating with the vane thereby forming a fluid seal. In other embodiments, described herein below, one or more of the bushings may have a different shape or size. For instance, the bushing may include a first curved surface, such as the surface disposed in a bushing chamber, and a second curved surface, such as the surface contacting the vane. In certain instances, a first of the curved surfaces has a radius smaller than the second curved surface. One or more of the bushings may additionally include one or more dimples on a surface thereof. In further embodiments, one or more of the bushings may be comprised of one or more parts or members, e.g., two members, such that the overall bushing length can vary in an axial direction.

Additionally, one or more bushing bearings may be present within the bushing chamber and/or the bushing chamber itself may be configured to form a bushing bearing. The bushing bearing(s) may be affixed to the bushing chamber. One or more additional elements, such as a compliant member, as described below, may further be present within the bushing chamber and/or associated with a bushing bearing and/or bushing. In certain instances, at least one of the vane and the bushing bearing may have one or more abradable coatings. For instance, the vane may have a first coating and the bushing may have a second coating, such as where in one coating is a relatively soft coating, and the other coating is a relatively hard coating. The coating may be any suitable coating and may include a polymer or metal base, such as a nickel base.

As depicted the bushing chamber 13 of the stator 2 is formed by opposing curved surfaces 13 which may interface with bushing bearings, which in turn interface with bushings 3. Consequently, the bushings 3 may include both a curved surface, designed to fit snugly within the curved recess of the bushing chamber 13 of the stator 2 and/or bushing bearings positioned therein, and a relatively flat surface, designed to interface with a flat surface of the vane 4. The bushings 3 in conjunction with the vane 4 from a fluid seal that separates the suction and/or compression space of the bore chamber 20 from the vane chamber 8.

The piston 5 is a cylindrical member comprising both an exterior portion having an exterior diameter and an interior portion having an interior diameter. The exterior portion diameter is less than that of the large bore diameter and thus the piston 5 does not occupy the entire space of the large bore chamber 20, but rather moves about in an orbital motion therein. The interior diameter portion forms an orifice within which a shaft 6 and a shaft eccentric 7 is positioned. The exterior portion of the piston 5 includes a cut out portion, e.g., a vane cleft, which is configured for receiving a distal portion of the vane 4. The vane 4 is affixed to the piston 5 such that relative motion between the vane 4 and piston 5 does not occur. Alternatively, the vane 4 and piston 5 can be a single component (not shown). The vane 4 interacts with the piston 5 and the bushings 3 so as to form two distinct subchambers within the large bore chamber 20, a first chamber, e.g., a suction chamber 15, and a second chamber, e.g., a compression 14.

The piston 5 is configured for moving, for instance, in an orbital pattern, within the bore 20 of the stator 2. For instance, the piston 5 is associated with a shaft 6 and a shaft eccentric 7 together which function to cause the piston 5 to rotate within the bore chamber 20. The shaft 6 is an elongate member that may be cylindrical and is configured for passing through or otherwise associating with the end plates 17 and 18 and/or bores therein, e.g., via bearings, and further configured for rotating. The shaft eccentric 7 includes associated bearings, e.g., rolling element bearings, and interfaces with the shaft 6 and the piston 5. The shaft eccentric 7 is configured for interacting with the piston 5, e.g., via a rolling element bearing, such as a needle and/or a ball bearing, in such a manner that the centerline of the piston 5 is offset from the centerline of the bore chamber 20, thus, the piston 5 will rotate within the bore chamber in a circular, e.g., orbital fashion. It is to be noted that in certain embodiments the rotation is such that as the piston moves the suction and/or compression spaces do not overlap the roller element bearings, which are fitted within the piston/eccentric elements. Also, it is to be noted that the shaft 6 and shaft eccentric 7 describe one means of affecting the orbital motion of the piston 5. For instance, the piston 5 could contain permanent magnets such that an motor coil not contacting the piston 5 could drive the piston 5 in an orbital motion.

As the piston 5 rotates within the bore chamber 20, the vane 4 moves up and down against the bushings 3 within the vane chamber 8. The flat surfaces of the vane, therefore, slide up and down against the flat surfaces of the bushings 3. This contact interface functions, in part, to form a bearing and seal thereby separating the vane chamber 8 from the bore chamber 20. The configuration and motion of the piston with respect to the vane divides the bore chamber into two separate chambers, e.g., a suction chamber 15 and a compression chamber 14.

Specifically, the vane 4 in conjunction with the piston 5 creates and separates the large bore volume into two sub-bore volumes, a suction volume and a compression volume. The larger bore volume is created by the space between the outer diameter of the piston 5 and the interior diameter of the stator 3, which forms the large bore volume. This volume is separated into two distinct volumes, a suction and a compression volume, by the interaction of the vane 4 with the piston 5. Additionally, the bushings 3 interact with the vane 4 so as to separate these volumes from the volume within the vane chamber 8.

As depicted, the piston 5 is offset from a centerline of the large bore such that as the piston orbits within the bore the outer diameter portion of the piston approximates the exterior surface of the stator 2. In certain instances, the outer portion may contact the exterior surface defining the stator bore chamber, in other instances there will be a small clearance therebetween. In instances where there is a small clearance, this clearance may be from about 1 micron up to and including about 50 microns. For instance, where there is a radial clearance, such as between tangential surfaces of the piston and chamber wall surface, the radial clearance may range from about 1 to about 100 microns, such as about 20 to about 80 microns, for instance, about 40 to about 60 microns, including about 50 microns. Additionally, where there is an axial clearance between axial surfaces, such as between the piston and endplates, the axial clearance may range from about 1 to about 100 microns, such as about 20 to about 80 microns, for instance, about 40 to about 60 microns, including about 50 microns. In certain instances, the compressor may have a compression ratio, such as a compression ratio between an absolute pressure of discharge and an absolute pressure of suction, wherein the compression ratio is between about 1 and about 5, such as between about 2 or 2.5 and 4, including about 3 and about 3.15.

Further, as depicted, the end plate 18 includes a suction port 10. This port is coincident with a portion of the bore chamber 20 such that a fluid, e.g., a gas, may be passed into the bore chamber thereby filling the space therein and forming a suction volume. However, the movement of the piston 5 is designed such that as the piston orbits within the larger bore chamber 20, the piston 5 increasingly covers over the suction port 10, thereby converting the suction volume into a compression volume.

Additionally, as depicted, the discharge end plate 17 includes a discharge port 19. This port is also coincident with a portion of the bore chamber 20 such that a compressed gas may be passed through the port thereby evacuating the chamber. Consequently, as the piston 5 orbits within the larger bore a suction volume is generated, it is compressed, thereby creating a compression volume, and discharged through the discharge port 19 of the end plate 17. The movement of the piston within the bore chamber will be described in greater detail with reference to FIG. 2. Other components of the compressor such as fasteners are not shown in FIG. 1.

As set forth above, in certain embodiments, the rotary piston compressor of the disclosure does not have a fluid lubricant, e.g., other than the process fluid, that is within contact of the chamber. For instance, the surfaces of the piston and vane and/or the endplates are configured such that none of the piston surface, the vane surface, and/or the endplate surface faces are in contact with a liquid lubricant or a non-Newtonian fluid. Hence, in certain embodiments, a liquid lubricant or non-Newtonian fluid is not present within one or more of the vane chamber, the bushing chamber, and/or the bore chamber, e.g., the suction sub-chamber or the compression sub-chamber. By non-Newtonian fluid is meant a pseudoplastic, a dilatant, a Bingham plastic, a thixotropic, a rheopectic, and a viscoelastic, and the like. It is to be understood, however, that in certain embodiments the only lubricant utilized within the housing is that lubricant that is, or at least is meant to be, completely encased within an element of the compressor, such as within one or more bearings, such as encased completely within a shaft or eccentric bearing.

Figure 2:
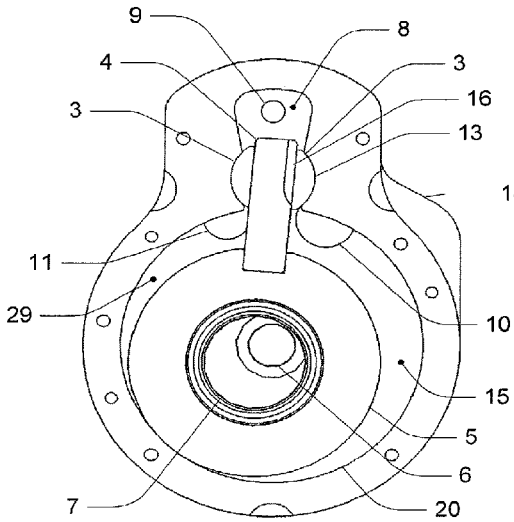
FIG. 2 is a front elevational view of an embodiment of a rotary compressor.

In certain embodiments, the rotary compressor is configured such that there is a radial clearance between tangential surfaces of the piston and bore chamber wall surface that is equal to or less than about 50 microns. Further, in certain instances, the radial clearance between axial surfaces of the piston and the endplates is equal to or less than about 50 microns. Additionally, in certain embodiments, the compression ratio between a pressure of discharge and a pressure of suction may within the range of between about 1 and about 2.5. Further, it is to be noted that in certain instances, the rotary compressor operates as a part of a system that does not re-circulate a closed volume of fluid repeatedly FIG. 2 shows a front view of an exemplary embodiment of the rotary compressor 1. In this view, the inlet or suction port 10 is visible in the suction endplate 18. The discharge endplate 17 is removed in this view for clarity. The location of the discharge port (not shown) is evidenced by the discharge dimple 11 that is located in the suction plate 18. Alternately, either the suction plate or the discharge plate may be integral with the stator and/or the suction and/or discharge ports can be positioned on other portions of the housing.

The shaft 6 has a cylindrical shaft eccentric 7 the centerline of which is parallel to but not concentric with the shaft 6 centerline. The shaft eccentric 7 occupies the space within the piston interior diameter, and is rotatably mounted with the inside diameter of the piston 5 such that the centerline of the piston 5 is eccentric with respect to the centerline of the stator bore chamber 20. The interface between the shaft eccentric 7 and the interior diameter of the piston 5 may additionally include one or more bearings, e.g., rolling element bearings, plain bearings, journal bearings, and the like.

As the shaft 6 rotates, e.g., clockwise, the offset ecentric rotates thereby driving the piston around in a rotation that is approximately orbital. The eccentricity of the piston 5 is such that the piston outside diameter contacts or nearly contacts a small zone of the stator surface defining the bore 20. Vane 4 extends radially from the piston 5. The vane is slidably engaged between the two bushings 3. The bushings 3 are rotatably engaged in the in the bushing chambers 13.

As the shaft 6 continues to rotate the piston 5 is driven along a circular or orbital path. Rotation of the piston 5 is limited by the engagement of the vane 4 with the bushings 3. Therefore, the motion of the piston 5 is nearly orbital.

The arrangement of the vane 4 and the eccentricity of the piston 5 is such that the volume within the stator bore chamber 20 is divided into a suction chamber 15 and a compression chamber 14. As the shaft 6 rotates, e.g., clockwise with respect to FIG. 2, fluid is passed through the inlet port 10, e.g., via tubing connected to a fluid source, and into the suction chamber 15 increasing in volume, while the compression chamber 14 is decreasing in volume. This increasing volume of the suction chamber 15 causes fluid to be drawn into the suction chamber 15 via the suction port 10. As the piston 5 moves in its orbital rotation, the suction port 10 gets increasingly closed off by the piston and the suction volume becomes a compression volume. As the piston 5 continues in its rotation, the compression volume decreases. The decreasing volume of the compression chamber 14 compresses the fluid in the compression chamber 14 until the pressure in the compression chamber is approximately the same pressure as the fluid downstream of the discharge port 19.

A valve may be present covering the downstream end of the discharge port 19 in a manner that the general flow of fluid is only permitted out of the compression chamber 14. For instance, when the pressure within the compression chamber is about equal to or greater than the pressure downstream of the discharge valve 29, the valve is caused to open and the fluid is forced out of the compression chamber 14.

As the shaft 6 continues to rotate the volume of the compression chamber 14 reaches a minimum and the volume in the suction chamber 15 reaches a maximum. Additional rotation isolates the suction volume 15 from the suction port 10. At this point the suction chamber 15 becomes the compression chamber 14. This cycle repeats as the shaft rotates, such that a continuous flow of compressed fluid is produced. Hence, fluid is continuously drawn in on one side, compressed and discharged on the other side of the larger bore chamber 20 of the compressor 1.

A vane chamber 8 is located near the top of the compressor in the FIG. 2 orientation. The vane chamber 8 acts in part as a clearance for the vane 4 such that as the piston 5 rotates, the vane is moved up and down in and out of the vane chamber 8 in a linear and/or rotational oscillation. An optional vane chamber vent 9 is located in the vane chamber 8. The vane chamber vent 9 may be included so as to control the fluid pressure within the vane chamber. The vent 9 may be controlled by an external or internal source. For example, in certain instances, a pressure source may be provided wherein the pressure source is in fluid communication with the vane chamber portion, e.g., through a controlled vane. Accordingly, a control mechanism may also be provided so as to control the fluid pressure in the vane chamber. In certain instances, the control mechanism may control one or more of the valve and/or a pressure source. The pressure source may be any suitable pressure source, and in certain instances, the pressure source may include an ambient pressure source, a pressure source that is above ambient pressure, or a pressure source is below ambient pressure.

In one embodiment of the present disclosure, an improved mechanism for controlling the load and wear on the contacting surfaces of the vane 4 and/or bushings 3 is provided. The vane chamber 8 is located in the stator 2. During a portion of the shaft 6 rotation, the vane extends into the vane chamber 8. In general, the vane chamber 8 is not in fluid communication with the suction chamber 15 or the compression chamber 14. Therefore, in addition to moments and forces imparted by the kinematics of the device, three distinct fluid pressures act on the vane 4 and bushings 3. These pressures can act on the bushings 3 and vane 4 in a way that increases friction. This is detrimental to the performance and reliability of the compressor.

There are, however, certain disadvantages associated with a constant pressure in the vane chamber 8. For example, when the piston 5 is nearest the bushings 3 the pressure in the compression chamber 14 may approximately be equal to the pressure in the suction chamber 15. If pressure in the vane chamber 8 is at the discharge pressure, fluid, e.g., gas, can leak around the vane 4 and bushings 3 into the discharge chamber 14 and/or suction chamber 15. This will result in a loss of efficiency.

In addition, there is pressure loading on the vane 4 and bushings 3 which can result in increased friction and wear. For instance, if the vane chamber 8 is in fluid communication with the suction chamber 15 then pressure on the vane 4 is initially balanced. However, as the shaft 6 rotates and the fluid is compressed a pressure load may be induced on the compression chamber side bushing 3. This fluid pressure imbalance can lead to leakage from the compression chamber 14 to the vane chamber 8. This would also result in a loss of efficiency. Furthermore, the same fluid pressure imbalance will impart a force on the compression chamber side bushing 3 that will urge the bushing into the vane chamber 8. This can increase friction between the vane 4 and bushings 3 and between the bushing chamber 13 and bushings 3. This would also result in a loss of efficiency.

Figure 22:
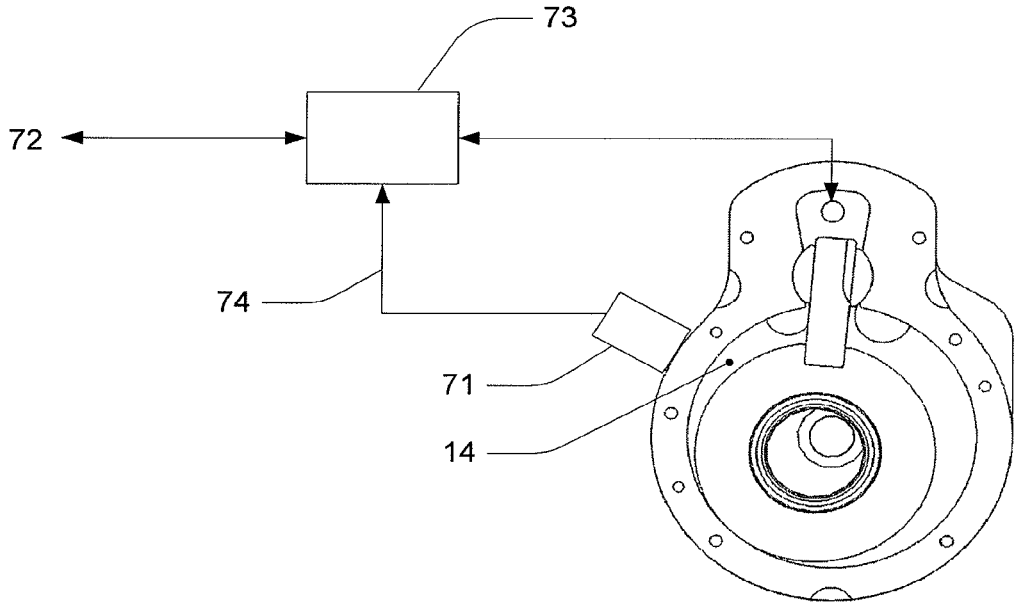
FIG. 22 is a front elevational view, similar to FIG. 19, and shows a rotary compressor system and associated control system.

In one embodiment of the present disclosure, therefore, the vane chamber 8 is sealed so that it is not in fluid communication with any other fluid volume. It is to be noted that in some practical devices some fluid leakage paths may be unavoidable, yet these will be insignificant with respect to the present embodiments. With the vane chamber 8 sealed, this volume can be purposefully set to a fluid pressure that is independent of the fluid pressure in the suction chamber 15, compression chamber 14, and/or discharge volume downstream of the discharge valve 29. This pressure can be held constant or be allowed to vary in time via a control mechanism as shown in FIG. 22, described in greater detail herein below. In this way the pressure in the vane chamber 8 can be optimized to minimize wear and leakage of the fluid being compressed.

Accordingly, another object of the present disclosure is to provide a control mechanism for controlling the pressure in the vane chamber 8. In one embodiment, the vane chamber 8 volume is fixed, except that the motion of the vane 4 into and out of the vane chamber 8, will compress and expand a fluid, e.g., a gas, therein as the vane enters and leaves the vane chamber 8. More specifically, when the piston 5 is furthest from the vane chamber 8 the vane 4 protrudes into the vane chamber 8 minimally. In this position, the vane chamber 8 is at its maximum fluid volume. However, when the piston 5 is closest to the vane chamber 8, the vane 4 protrudes into the vane chamber 8 a maximum amount. Therefore, at such a position, the vane chamber volume is at a minimum. The vane chamber volume will therefore vary between the maximum and minimum values nearly sinusoidally as the shaft 6 rotates. Therefore, the gas entrapped in the vane chamber 8 will alternately become compressed and expanded with a corresponding rise and fall in pressure. In so doing, the vane chamber pressure can be used to minimize leakage of the fluid being compressed, and minimize wear of the vane 4 and bushings 3 without the need for external control means.

Figure 3:
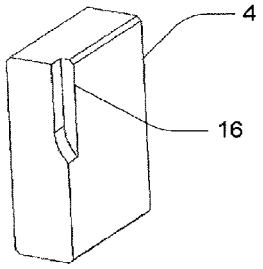
FIG. 3 is a perspective view of an embodiment of a vane of the rotary compressor of FIG. 2.

Another object of the present disclosure is a mechanism for controlling the vane chamber 8 pressure that is independent of the vane 4 position within the chamber for a certain portion of the crank revolution. For instance, in one embodiment, a relief 16 is cut into a portion of the vane 4 as shown in FIGS. 2 and 3. The relief 16 is shown on the suction chamber 15 side of the vane 4. The length of the relief 16 is such that when the vane 4 protrudes minimally into the vane chamber 8, e.g., the piston is furthest away from the vane chamber 8 and bushings 3, there is fluid communication between the vane chamber 8 and the suction chamber 15. When this occurs the fluid pressure in the vane chamber 8 and suction chamber 15 will equalize. This occurs when the piston 5 is relatively far from the vane chamber 8 and bushings 3. As the shaft 6 continues to rotate and the piston approaches the vane chamber 8 and bushings 3, the vane 4 is pushed further into the vane chamber 8. As the piston 5 moves closer to the vane chamber 8 and the bushings 3, the surface of the bushing 3 will cover the vane relief 16. Continued shaft rotation will cause the vane to protrude into the vane chamber 8, which will increase the pressure in the vane chamber.

In this way, the pressure in the vane chamber 8 varies with crank angle and the load the pressure in the vane chamber transmits to the bushings 3 may be controlled.

For instance, the pressure can be varied, e.g., to be about equal to the pressures in the suction and/or compression chambers. This may be important in situations where the pressure in the suction chamber 15 is lower than the pressure in the vane chamber 8 and such pressure differential results in a frictional force being applied to the bushing 3, which force tends to push the bushing, or a portion thereof, into the vane chamber 8. Having vane relief or cutout 16 in vane 4 will equalize the two pressures, e.g., when the piston is furthest away from the bushings, thereby negating this disruptive force and minimizing wear on the bushing 3.

As the piston continues in its rotation and the compression pressure in the compression chamber increases, the cutout moves upwards and is covered by the bushing 3, thereby resulting in an equivalent increase of pressure in the vane chamber 8. Hence, the pressure in the compression chamber 14 also varies with crank angle. Therefore, using this approach the pressure imbalance on the left bushing 3 can be minimized. Accordingly, this will reduce friction and wear of the bushing. It should be noted that the length of the vane relief 16 can be varied to optimize the position of the piston 5 at which fluid communication between the vane chamber 8 and suction chamber 15 begins and ends. Furthermore, the volume of the vane chamber 8 and the geometry of the vane 4 can be varied to optimize the change in vane chamber pressure with piston position.

Figure 4A:
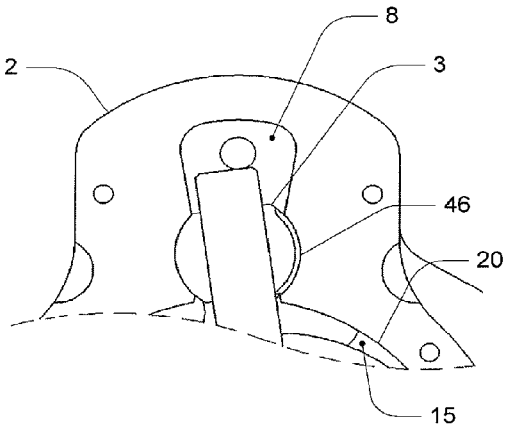
FIG. 4*a* is a partial front elevational view of an embodiment of a stator and bushing with a chamfer added to the bushing on a suction chamber side, and shows a vane chamber and a suction chamber in fluid communication.
Figure 4B:
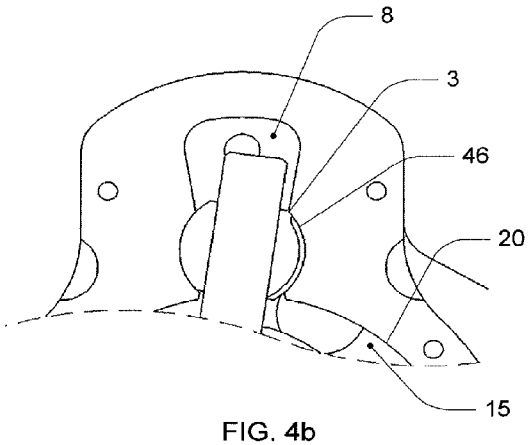
FIG. 4*b* is a partial front elevational view similar to FIG. 4*a*, and shows the vane chamber and the suction chamber no longer in fluid communication.
Figure 5:
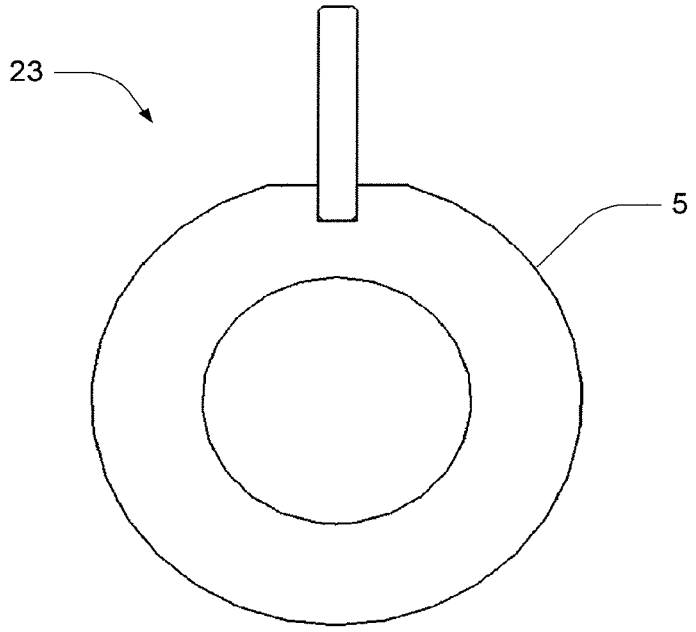
FIG. 5 is a perspective view of an embodiment of a piston and shows piston recesses formed in axial faces of the piston.

FIG. 4 shows an embodiment that is similar to the FIG. 3 embodiment for controlling pressure within the vane chamber. In this embodiment a relief cut or chamfer 46 is added to the bushing 3 at the bushing chamber/bushing bearing surface interface of the stator 2. The relief cut is positioned on the bushing on the suction chamber 15 side of the large bore chamber 20. The length of the chamfer is such that at certain positions of the piston's orbit, the vane chamber 8 and suction chamber 15 are in fluid communication, as depicted in FIG. 4 (*a*); whereas at other crank angles, the chambers are no longer in fluid communication, as depicted in FIG. 4 (*b*). Other configurations are possible and would be obvious to one with ordinary skill in the art.

Other problems can also effect the efficiency of fluid compression as well as increase wear on the components of the rotary compressor. For instance, as described with reference to FIG. 2, when the discharge port is located in one of the endplates of the rotary compressor, e.g., discharge endplate 17, the piston in its orbital movement will cover the discharge port for part of the crankshaft revolution. When this occurs the axial face of the piston may be exposed to discharge pressure. This may result in an axial force being exerted on the piston, which in turn can cause the piston to move axially thereby contacting the opposing endplate, e.g., suction plate 18. This contact can result in excessive wear or damage to the suction plate 18 and/or the piston 5. This is especially true for oil-less compressor designs since there is no lubricant present to prevent contact between said components. A similar effect is possible when the suction port is located in the suction plate 18. The suction plate 18 and discharge plate 17 are collectively referred to herein as endplates.

Figure 2A:
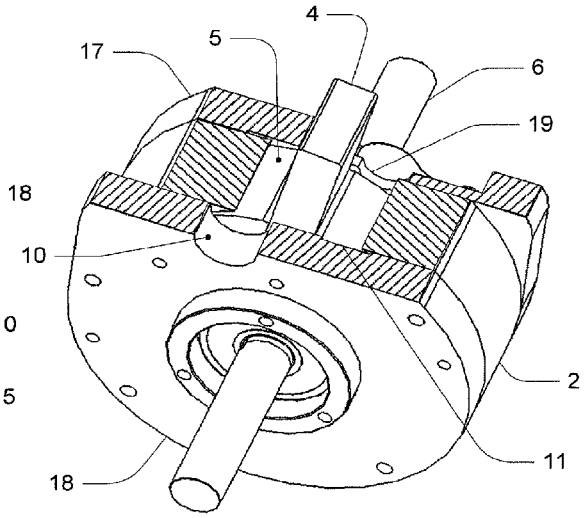
FIG. 2*a* is a perspective cross-sectional view of an embodiment of a rotary compressor.

Accordingly, in one embodiment of the present disclosure, a recess is formed in the opposing endplate. The recess may be positioned radially and circumferentially so that it is in approximate alignment with the discharge port 19 and/or the suction port 10. Specifically, the suction plate 18 may have a discharge dimple 11 (see FIG. 2*a*) and the discharge plate 17 may have a suction dimple (see FIG. 2*a*). The discharge dimple 11, compression chamber 14, and volume upstream of the discharge port valve are all in fluid communication at least until the piston fully covers the discharge port 19 and discharge dimple 11. The discharge port 17 and discharge dimple 11 may remain in fluid communication even when the piston fully covers the discharge port 17, due to natural flow paths in the area of the vane 4 and bushings 3 and the proximity of the discharge port 17 to the vane 4. For instance, in certain embodiments, the rotary compressor includes a discharge port that is positioned in one endplate wherein the second endplate includes a cutout portion that forms a blind hole which is in axial opposition to the discharge port.

The pressure of gas in the discharge dimple 11 will be similar to the pressure of gas upstream of the valve in the discharge port 17. Therefore, an axial force imposed on the piston by gas pressure in the discharge port will be balanced by the axial force imposed on the piston by gas pressure in the recess. The shape and size of the recess are similar to that of the discharge port, although other shapes and sizes could be devised that would have similar effect. The suction dimple has a similar effect. Other forces can also cause the piston 5 or vane 4 to come into contact with one of the endplates. For example, if the shaft 6 is parallel with gravitational acceleration, the piston will tend to be pulled into contact with one of the endplates.

Another embodiment of the present disclosure can prevent contact between the piston 5 and endplates 17 and 18 when arbitrary axial forces are present. In this embodiment, shown in FIG. 5, piston recesses or reliefs 21 are formed in one or both of the axial faces of the piston 5 so as to create a hydrostatic bearing between the surfaces of the opposing surfaces of the piston and the endplates. These recesses may be in fluid communication with fluid, e.g., gas, in the compression chamber for a portion of the crank revolution. For instance, such communication can occur with a flow path 22 between the large bore chamber, e.g., compression chamber 14, and piston recess 21, so as to pressurize the space between the recess and the endplate. It can also occur when the piston recess 21 and discharge port 17, or discharge dimple 11, intersect for a portion of the shaft 6 rotation. Such fluid communication pressurizes the piston recesses 21 to a pressure similar to that of the compression chamber 14. It is understood that once the piston recess 21 is pressurized some of the pressurized fluid may leak out of the recess since there may be a very small but non zero clearance between the axial face of the piston 5 and the endplates.

If an axial force causes the piston 5 to move toward one endplate, e.g., the suction plate 18, the leakage clearance between the suction plate and axial face of the piston 5 will decrease. This will reduce the leakage rate of fluid from the piston recess 21 on the suction plate 18 side. The leakage of fluid from the piston recess 21 discharge plate 17 side, however, will increase. This will result in a pressure imbalance that will push the piston 5 axially away from the suction plate 18, thus preventing contact between these components. This restoring force works in both directions along the axial axis such that the piston 5 "floats" between the endplates without contacting them.

The general shape of the compressor piston 5 is that of a right circular cylinder with a vane 4 portion extending radially from the piston 5 outside diameter. A generally cylindrical hole is situated concentrically with the piston 5 outside diameter. This hole accepts a drive means which drives the piston 5 eccentrically with respect to the center line of the stator bore 20.

Figure 6:
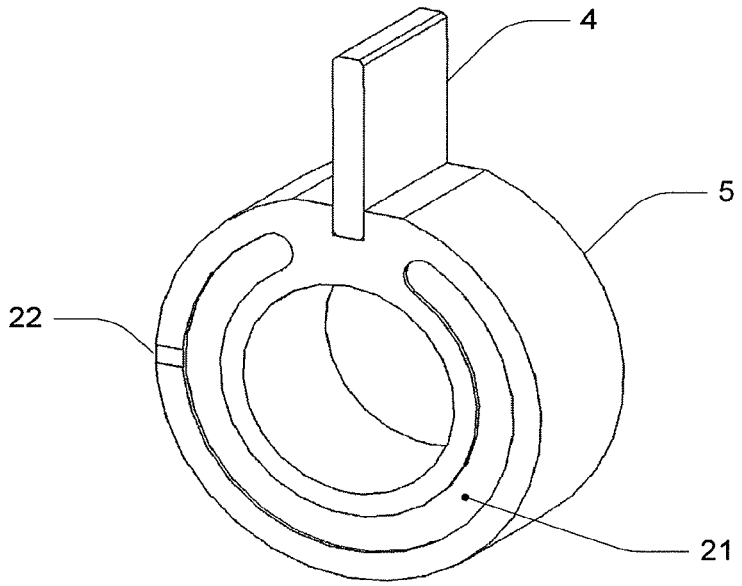
FIG. 6 is a front elevational view of a vaned piston and shows concentric outside diameter and inside diameters.

FIG. 6 shows the vaned piston 23. In this configuration the piston 5 outside diameter and inside diameter are concentric. The center of mass of the vaned piston 23, therefore, is not at the horizontal center line of the inside diameter. This causes an imbalance when the compressor is running that is not easily corrected with simple counterweights.

Figure 7:
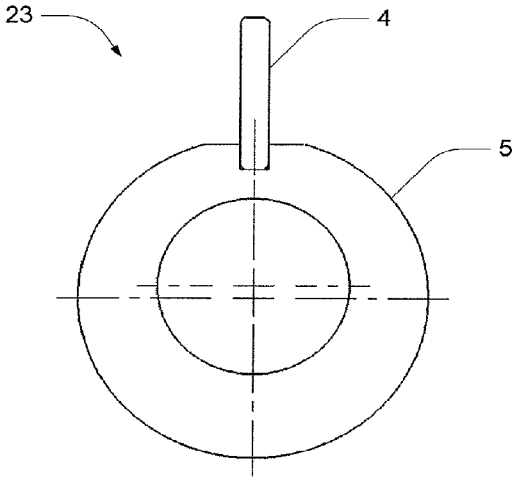
FIG. 7 is a front elevational view of another embodiment of a vaned piston.

Accordingly, in another embodiment of the present disclosure, as shown in FIG. 7, the piston is balanced. For instance, as depicted the hole in the center of the piston 5 is shifted radially, upward, toward the vane 4, such that the centerline of the hole is coincident with the center of mass of the part. Specifically, as depicted, the inside diameter of the piston is shifted toward the vane, e.g., upwards. Hence, the inside and outside diameters of the piston 5 are not concentric. The center of mass of the piston 5 and vane 4 combination 23 is therefore centered within the geometric center of the interior diameter of the piston. The amount shifting is exaggerated in the figure. This arrangement allows simple counterweights to fully correct the imbalance caused by the eccentric motion of the piston mass. This configuration, therefore, will reduce vibration and thereby reduce noise and wear on the component parts. Hence, in certain embodiments, the compressor includes a piston that is configured such that the center of mass of the piston and the vane combination is coincident with the piston's orbital circle.

Further, in certain embodiments, the piston includes one or more cutout portions, such as where the cutout portion does not intersect the outer periphery of the piston. In certain instances, the cutout forms a chamber, such as in an axial surface of the piston wherein the chamber includes an accumulator volume. In certain instances, the chamber is configured such that the accumulator volume is in communication with one or more of the suction chamber and/or the compression chamber. In certain instances, the chamber is configured such that the accumulator volume does not affect the compressor displacement volume and in other instances, the cutout decreases the compressor displacement volume. In various embodiments, the piston and/or the one or more chambers are configured to facilitate a rise in static pressure between the endplate and the axial piston surface so as to maintain clearance between the endplate and the axial piston surface.

Figure 8:
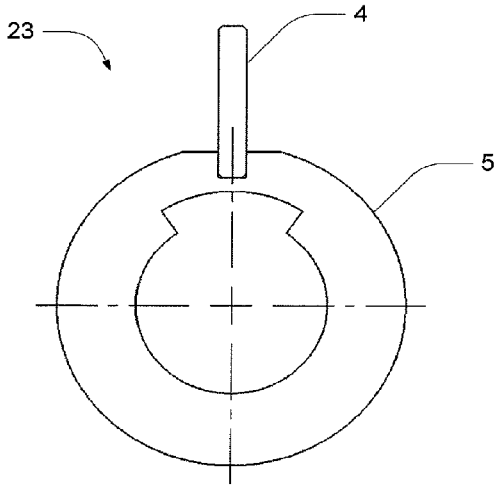
FIG. 8 is a front elevational view of a further embodiment of a vaned piston.
Figure 9:
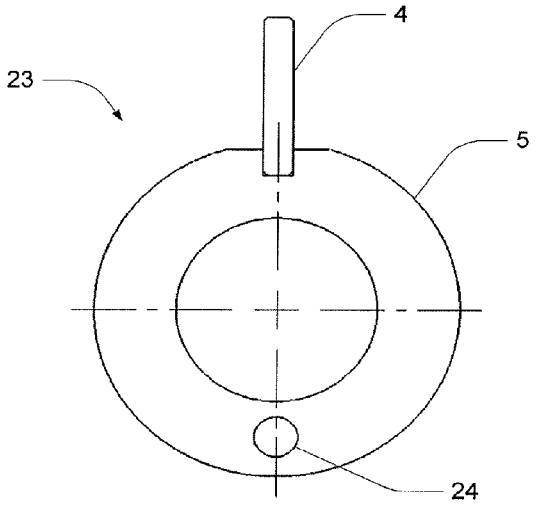
FIG. 9 is a front elevational view of a still further embodiment of a vaned piston.

FIG. 8 shows another embodiment for achieving the above benefits, namely, where material is removed from the piston 5 inside diameter so that the center of mass remains at the inside diameter geometric center line. Other modifications could achieve the same results, such as, by adding a high density insert 24 to the piston opposite the vane as shown in FIG. 9. Any number of modifications of the embodiments shown in FIGS. 8 and 9 could achieve the same results. For instance, a plurality of cutouts in the piston above the horizontal centerline could be used to achieve the same effect. These cutouts could, for instance, be filled with a low density insert or could be left open. In general, it is desirable for the piston 5 and vane 4 combination center of mass to be coincident with the piston's orbit circle, centered at the bore chamber centerline. In practice, design constraints or manufacturing tolerances can result in deviations from the ideal. For instance, a relatively large cutout portion for balancing the piston 5 and vane combination 4 may result in a piston that is structurally weak. Even so, a smaller cutout portion can still reduce imbalance. Therefore, for the purpose of this disclosure a balanced piston 5 and vane 4 combination is one in which the average distance of the center of mass from the orbit circle is less than it would be without the balancing feature as described above.

Figure 10:
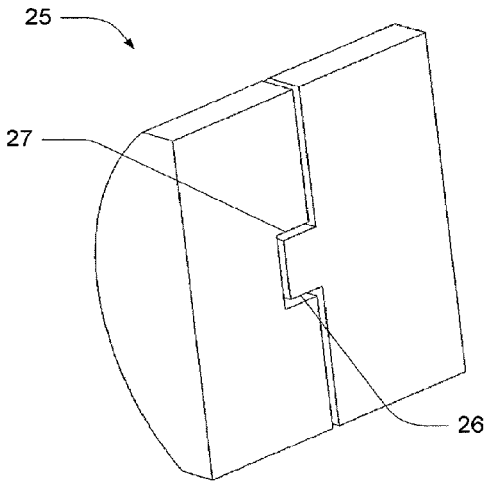
FIG. 10 is a perspective view of an embodiment of a bushing for the rotary compressor.

FIG. 10 shows an embodiment of a bushing for use in a rotary compressor of the disclosure. In a typical lubricated rotary compressor, the liquid lubricant seals leakage gaps between adjacent parts that surround the compression space. This is true for the leakage path that exists between the bushings 3 and the endplates 17 and 18. For an oil free compressor leakage gaps have to be very small or a contacting seal needs to be used. Keeping the leakage gap between the bushings 3 and endplates acceptably small requires very precise machining, which is expensive. Also, the material used for the bushing is not necessarily the same as the material used for the stator 2 and vane 4. Therefore, thermal effects may cause the clearance to vary during operation.

Accordingly, a multi-piece bushing design has been developed. The two piece bushing design 25 shown in FIG. 10 overcomes these challenges. The tongue 26 of a first bushing part and the groove 27 of a second bushing part in a two-piece bushing 25 acts in a manner similar to a piston ring, where the gas pressure between the two pieces act to push the bushing pieces apart allowing them to seal against the endplates. If useful a spring could also be used to bias the two halves of the bushing. The same pressure forces that push the bushing halves apart will cause one surface of the tongue 26 and groove 27 to contact each other and provide a seal so that leakage between the two halves is minimal. This configuration is useful for promoting the sealing of the bushings with respect to the endplates. For instance, the thickness of the bushings needs to be as thick as, but not thicker than, the thickness of the housing, e.g., stator, otherwise if the bushing is too thin, a leak path is generated allowing fluid to flow from the vane chamber 8 to the larger bore chamber 20, and/or if the bushing is too thick it will prevent the endplates from properly sealing against the stator. The fluid pressure induced biasing force can be increased or decreased by adjusting the geometry of the tongue 26 and groove 27 and the location of the tongue 26 and groove 27, for instance, changing the vertical position, as shown in FIG. 10.

Figure 11:
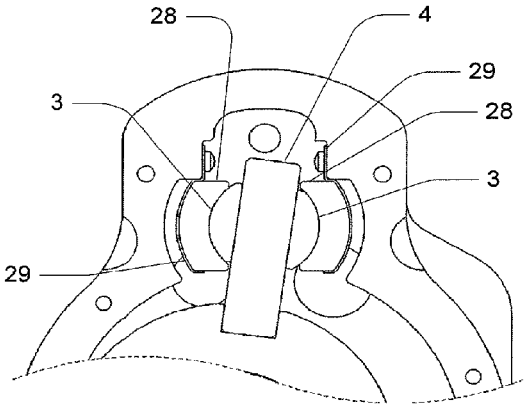
FIG. 11 is a front elevational view of an embodiment of a compliant bushing bearing.

FIG. 11 shows a compliant bushing bearing 28. Typically bushing bearings are fixed structures. The disadvantage of this is that if the bushing bearing 28, bushing 3, or vane 4 wear there will be increased clearances between components that can lead to leakage, vibration, and noise. The compliant design uses a compliant member, such as a spring 29, or an elastomer, to bias the bushings 3 against the vane 4. A fixture can be included to hold the compliant member in place. Therefore as wear occurs the bushings 3, bushing bearings 28, and vane 4 will remain in contact. Additionally, the compliance member may act to dampen vibration caused by the rotational motion of the piston, for instance, by causing the vane 4 to stay more vertical. For instance, during operation the piston 5 oscillates rotationally. This results in a torsional imbalance. The springs 29 or elastomer can be designed with the appropriate spring rate and damping force to counterbalance the torsional imbalance. As depicted only one compliance member is shown, however, two or more compliance members may be employed, for example, one on each side of the stator/bushing assembly.

Figure 12:
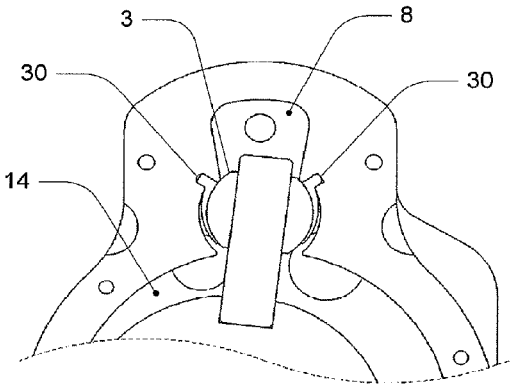
FIG. 12 is a front elevational view of an embodiment of a bushing bearing hinged on one end.

In FIG. 12 the bushing bearing 30 is hinged on one end, which end may be configured for being fitted within a complimentary receiving portion of the stator. In such an embodiment, the fluid pressure difference between the vane chamber 8 and compression chamber 14 is used to bias the bushing bearing 30 against the bushing 3 so as to keep the bushing firmly pressed against the vane and so that wear of components can be tolerated, especially given the various chamber pressure differentials.

Figure 13:
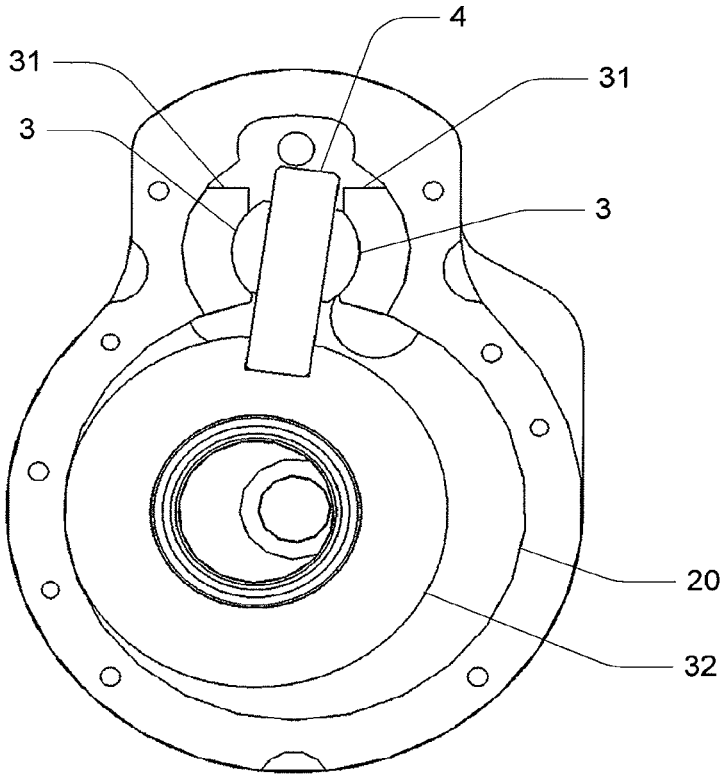
FIG. 13 is a front elevational view of another embodiment of a rotary compressor.

FIG. 13 discloses another embodiment of the present disclosure. In this embodiment, the vane 4 and/or bushing bearings 31 are fabricated from a highly wear resistant material, that is different from the base material of the stator and/or piston. Alumina and other such hard materials are very wear resistant. However, the cost of making the entire compressor out of such hard materials like alumina would be very high. Aluminum, on the other hand, is relatively inexpensive, but if the vane 4, bushings 3, and bushing bearing were all fabricated from aluminum, liquid lubrication would be required to achieve reasonable reliability. The use of hard inserts for the components that contact one another, in this instance, the bushing bearing, provides a cost effective means for greatly reducing the compressor cost and improving reliability without requiring liquid lubrication. Alternatively, coatings such as diamond like carbon, and/or Xylan 8114 (or similar low-friction, wear-resistant composites of fluoropolymers and reinforcing binder resins) could be applied to the same areas of the compressor. The bushing bearings 31, bushings 3 and vane 4 are not limited to being very hard materials. Certain plastic formulations with base resins such as polyimides, polyamide-imides, and polyether-ether-ketones have high wear resistance and lubricity under conditions of dry sliding contact.

In another embodiment, also shown in FIG. 13, the outside diameter of the piston and/or the stator inside diameter 20 may be coated with an abradable coating. The thickness of the coating is such that a small interference exists between the piston outside diameter 32 and the stator inside diameter 20. This interference may exist for some orbital positions of the piston 5 or for all piston 5 positions. During operation of the compressor the abradable coating wears off so that line to line contact is achieved between the components. This results in a very low leakage rate between these components as well as low frictional losses since contact is negligible. Abradable coatings may also be used on the axial faces of the piston and vane and/or endplates to achieve similar reductions in leakage across these surfaces. The use of abradable coatings may permit features of the compressor, for instance, the piston outer diameter to be made with less precision without sacrificing efficiency since the abradable coatings will wear away for near perfect mating. This may reduce the manufacturing cost of the compressor.

Figure 14:
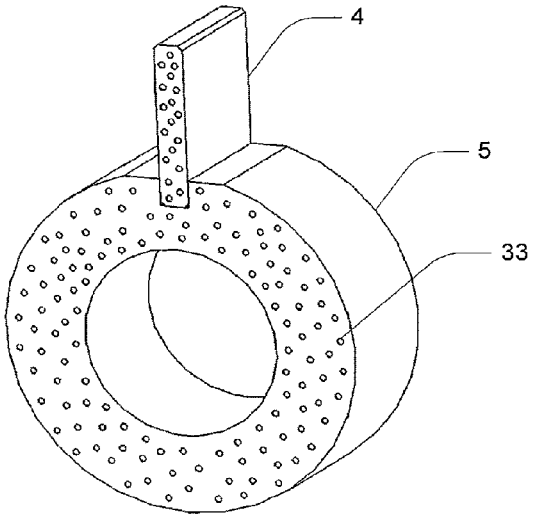
FIG. 14 is a perspective view of another embodiment of a vaned piston and shows dimples added to the surfaces of the piston and vane.

FIG. 14 shows another embodiment of the present disclosure. Cut outs, such as shallow dimples 33 may be added to one or more of the surfaces of the piston 5 and/or vane 4 so as to form a fluid-dynamic bearing. Specifically, fluid fills the small clearance between the suction endplate 17, for instance, and an axial face of the piston. When the piston 5 orbits, the dimples 33 will cause a pressure rise of the fluid in the gap. This results in a force that pushes the piston 5 away from the endplate. The force decreases as the gap between the endplate and piston 5 increases. When dimples 33 are on both axial faces of the piston 5 the fluid-dynamic bearings tend to center the piston 5 between the endplates 17 and 18. This minimizes contact between the piston 5 and endplates, which can reduce wear and improve efficiency. Additionally, another purpose of the dimples is to make any leakage flow paths more arduous. The effect of this is that the mass flow rate of fluid through the leakage path is reduced. These modifications result in an efficiency improvement. The inside surface of the endplates, piston 5 outside diameter, and/or stator inside diameter 20 may also be dimpled to achieve the same effect. Other surface modifications may be used. For example, the surface could be bead blasted or radial cutouts could be used to achieve a similar effect.

Figure 15:
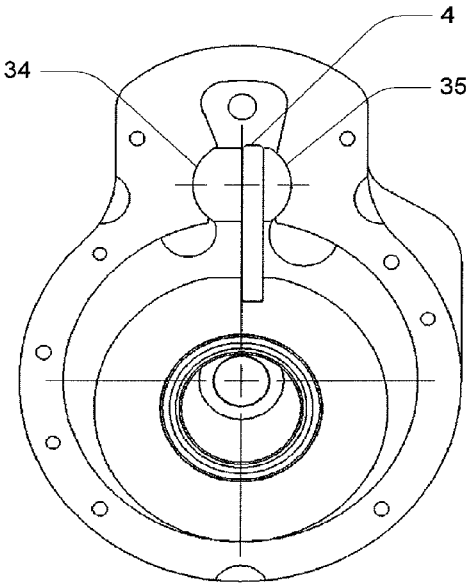
FIG. 15 is a front elevational view of a portion of an embodiment of a rotary compressor and shows a compression side bushing larger than a suction side bushing.

FIG. 15 shows a portion of a rotary compressor where the compression side bushing 34 is of a different size, e.g., larger, than the suction side bushing 35. Specifically, the radius of the compression side bushing 34 extends for more degrees of arc than the suction side bushing 35. Accordingly, when the vane 4 moves in and out of the slot created by bushings 34 and 35, friction tends to drag the bushing in the same direction as the vane motion. When this occurs the bushings tend to act as wedges between the bushing bearings 36 and 37. This can cause binding to occur especially as parts wear. The problem of binding primarily tends to affect the compression side bushing 34 more than the suction side bushing 35, therefore, it is advantageous to make the compression side bushing 34 larger. However, in certain instance this configuration may be reversed as desired, for instance, in configurations where bushing 35 tends to wear faster than bushing 34.

Figure 16:
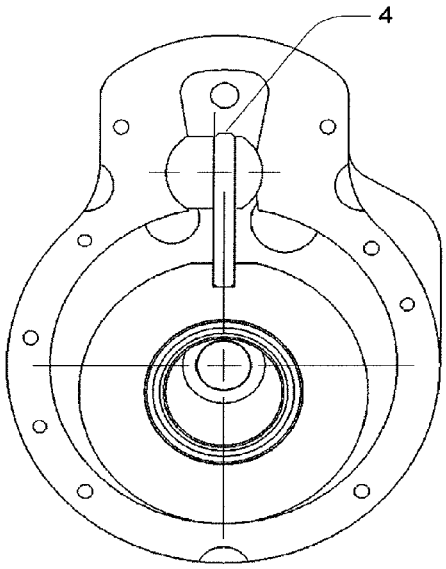
FIG. 16 is a front elevational view of a portion of another embodiment of a rotary compressor and shows different size bushings.

FIG. 16 shows another embodiment with different size bushings. In this embodiment, the vane 4 remains symmetric with respect to bisecting the piston. As depicted the bushing and bearing have been shifted to the left, whereas in FIG. 15 the vane 4 is off center, e.g., positioned right of the center line of the piston.

Figure 17:
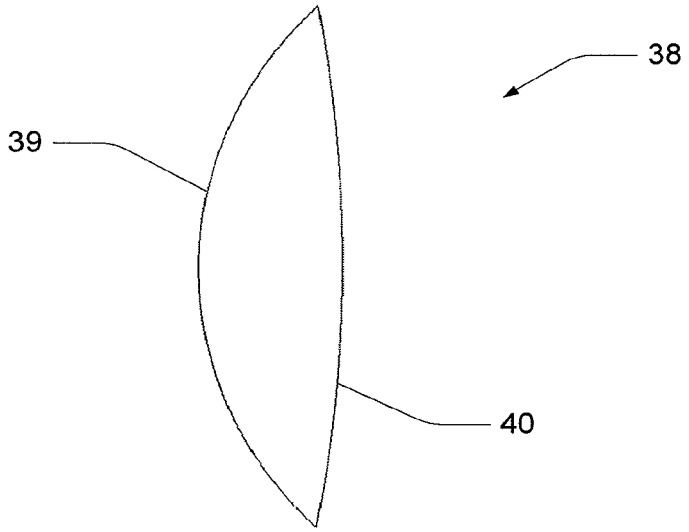
FIG. 17 is a front elevational view of an embodiment of a bushing.

FIG. 17 shows another embodiment of the present disclosure. In this embodiment the bushing 38 shown has a radius 40 on the surface which is curved, whereas typically this surface is flat. The journal radius 39 mates with the bushing bearing in the typical manner. The curved radius 40 has several advantages. For example, it helps direct the forces that act on the vane 4 and bushing 3. For instance, for a given vane 4 thickness and journal radius 39 the radius 40 decreases the mechanical advantage of the bushing with respect to its ability to bind the vane 4. Hence, this configuration gives the bushing a geometry that is tolerant of wear, and dependent on the bias of the curvature of 40 (proximal or distal with respect to the piston), the mechanical advantage may be adjusted upwards or downwards.

Figure 18:
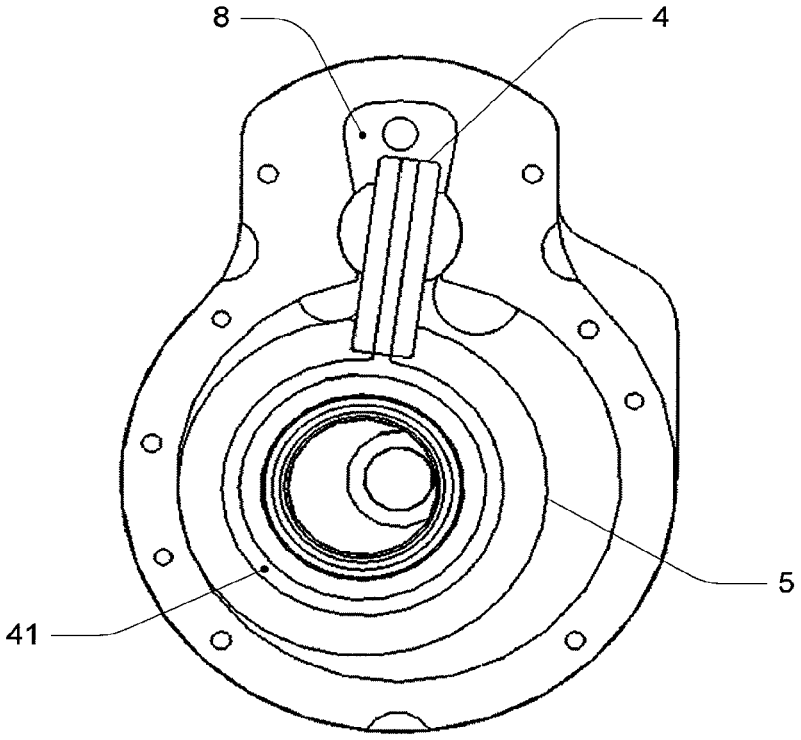
FIG. 18 is a front elevational view of a further embodiment of a rotary compressor.

FIG. 18 shows another embodiment of the present disclosure. In this embodiment, a shallow recess is cut into the vane 4 which is coincident with a shallow recess cut into the piston 5. Hence, compressed gas from the vane chamber 8 is in fluid communication with the recesses in the vane 4 and axial face of the piston 5. The opposing axial faces of the piston 5 and vane 4 may have a similar feature. The pressure of the fluid in the recesses 41 keeps the piston from contacting the endplates in a manner similar to the embodiment disclosed in FIG. 5. Other configurations for the flow passages are also possible.

Figure 19:
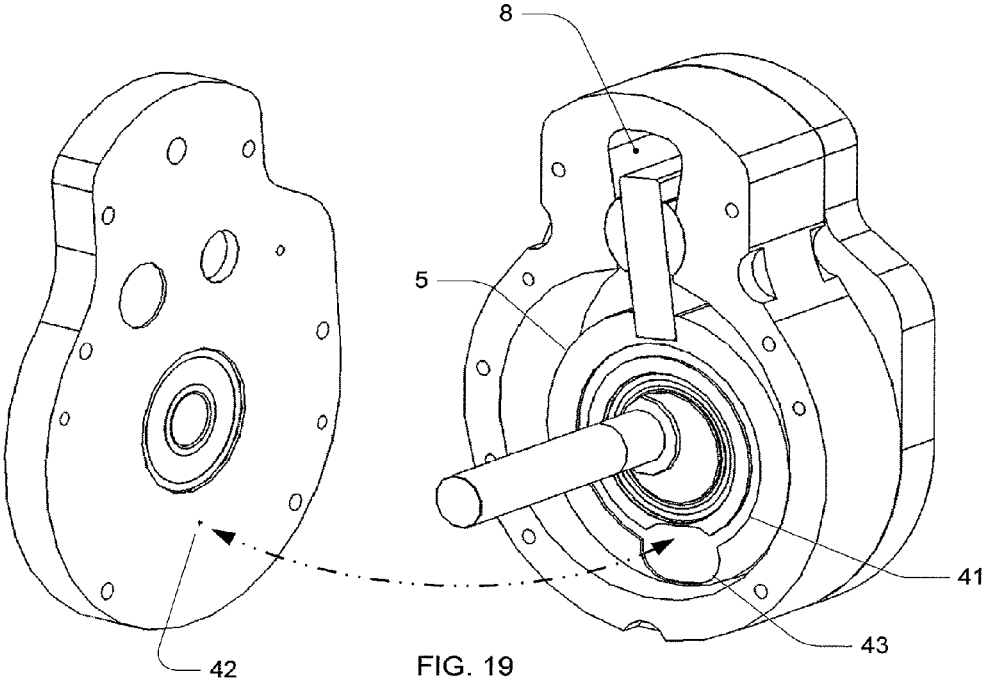
FIG. 19 is a exploded perspective view of a still further embodiment of a rotary compressor.

FIG. 19 shows a similar embodiment where the fluid is fed from ports in the endplates (not shown). The recess 41 can be positioned in the endplates or both the endplates and pistons. The port 42 in the endplate is shown where it intersects the recess 41 at enlarged pocket 43 in the piston 5. In a manner such as this, the recess 41 may be pressurized so as to form an air bearing which functions to keep the piston centered axially between opposing endplates.

Figure 20:
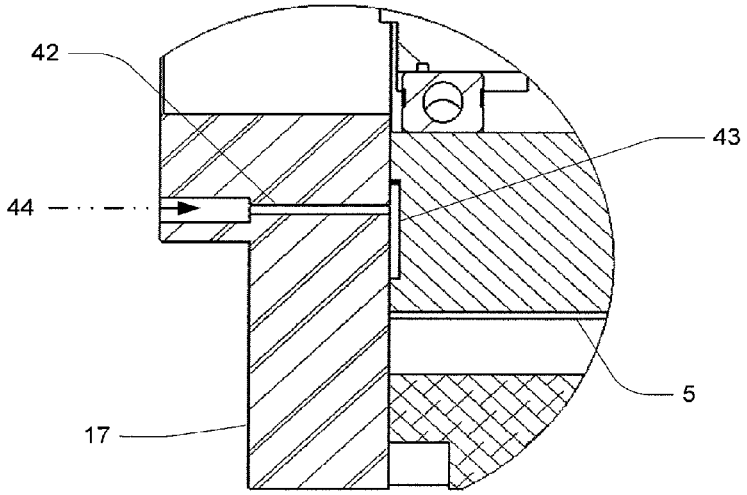
FIG. 20 is a cross-sectional view of a section of an embodiment of a discharge plate and a piston.

FIG. 20 shows a section of the discharge endplate 17 and piston 5 where fluid 44 is in communication with the recess 41 at pocket 43 via port 42. For instance, in certain instances, at least one endplate includes a chamber. The chamber can include a cutout portion, such as a cutout portion that is adjacent to an axial surface of the piston and/or configured to facilitate a rise in static pressure between the endplate and the axial surface of the piston. The chamber may form a port, where the port may be in fluid communication with the chamber on the surface of the piston. A fluid pressure source may be connected to the port such that the pressure source is communicated to the chamber for at least a portion of the piston's orbit. In certain instances, one endplate may include the chamber and the second endplate may include the discharge port, such as where the discharge port is in axial opposition to the chamber. In one instance, the chamber of the piston extends from one axial surface to another axial surface of the piston thereby providing fluid communication between axial surfaces of the piston. In certain instances, the chamber functions to equalize pressure between either end of the end plate.

Figure 21:
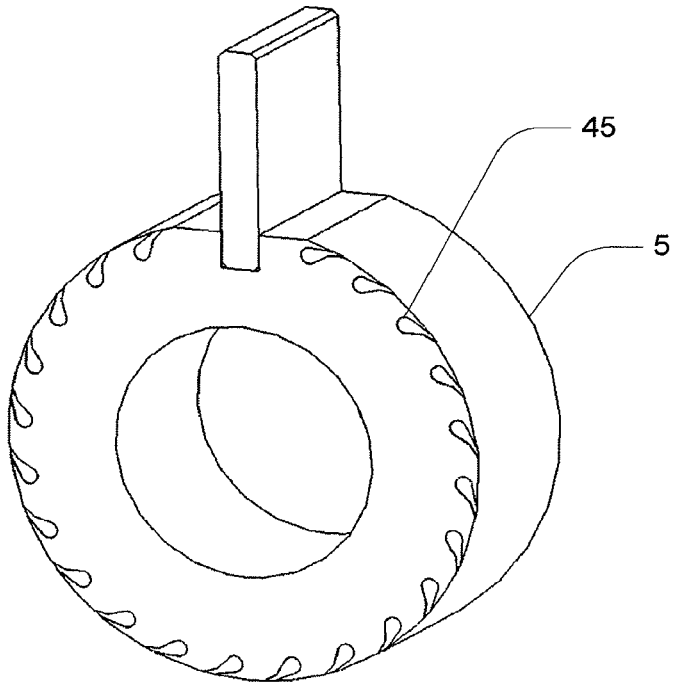
FIG. 21 is a is a perspective view of another embodiment of a vaned piston and shows an embodiment for floating the piston.

FIG. 21 shows another embodiment for balancing the piston axially, involving floating the piston. Cut outs or recesses 45 intersect the outside diameter of the piston 5. The motion of the piston causes the recesses to pressurize and dynamically compresses the fluid in the recess 45. One or both sides of the piston may include recesses 45. The velocity head is converted to static pressure head via diffusion. This keeps the piston 5 from contacting the endplates in a manner similar to the embodiment disclosed in FIG. 14.

FIG. 22 shows an embodiment where a sensor 71 is placed in communication with the compression chamber 14 and a fluid pressure source 72 is placed in fluid communication with the vane chamber 8 via a controller 73 so as to control pressure in the vane chamber and improve efficiency and/or decrease wear. The signal 74 from the sensor is used to command the controller to variably apply pressure from a fluid pressure source to the vane chamber. The controller may be any suitable controller and may take the form of a mechanical, e.g., pneumatic, valving system, an electromechanical valve, and/or a computer. For instance, any mechanism for controlling the vane chamber pressure as a function of crank-angle may be employed. The sensor may take the form of a proximity sensor, a pressure sensor, hall effect sensor, or other type of sensor which conveys pressure and/or position data, as known in the art.

Figure 23:
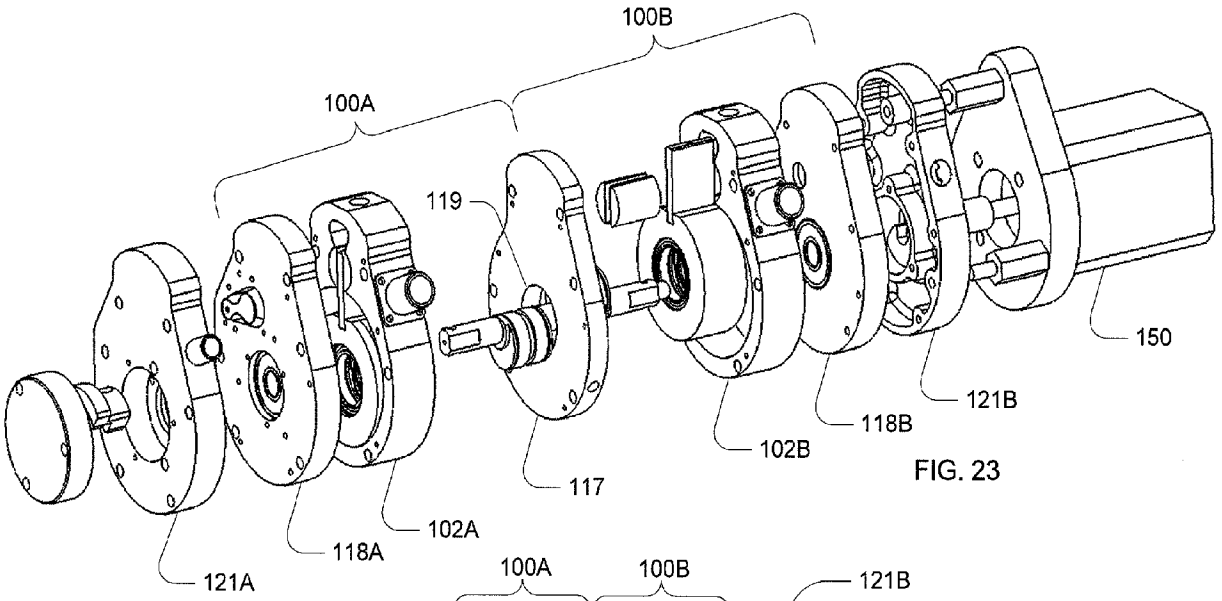
FIG. 23 is an exploded perspective view showing two rotary compressors operated by a single motor.
Figure 23A:
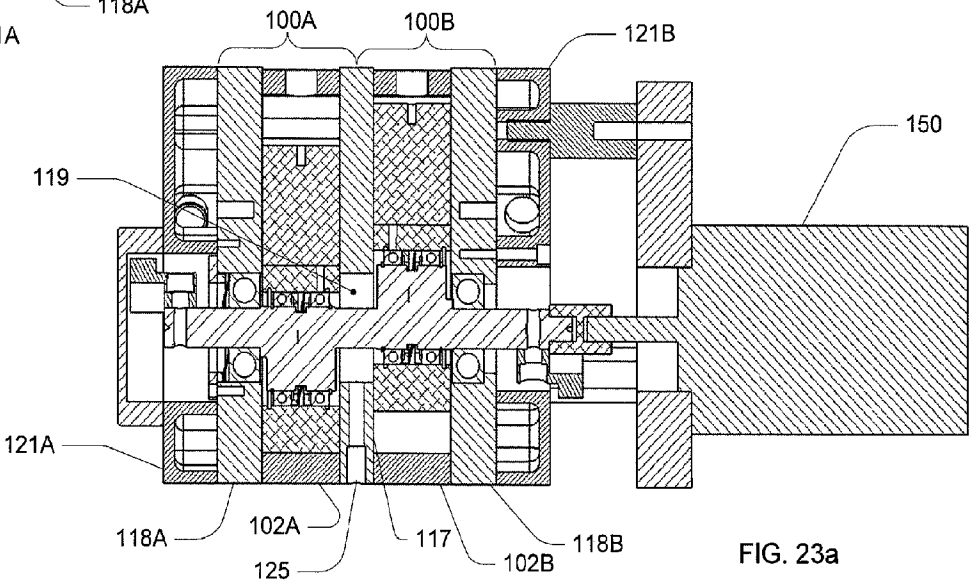
FIG. 23*a* is a cross-sectional view showing two rotary compressors operated by a single motor.

FIG. 23 shows an embodiment where two compressors 100A and 100B are driven by a single motor 150. As can be seen with respect to FIG. 23, the first compressor 100A includes a housing 102A, which is positioned between two endplates 118A and 117. The second compressor 100B includes a housing 102B, which is also positioned between two endplates 118B and 117. As depicted, both compressors 100 A and B share the common endplate 117. However, in certain embodiments, each compressor can each have its own, non-shared endplates. Additionally included are mufflers 121A and 121B. When considering the two compressors being driven by a single motor, as shown in FIG. 23, one compressor may act to increase pressure above ambient pressure, and one compressor may act to reduce pressure below ambient pressure. In certain instances, gas may leak into an endplate chamber, for instance, into endplate chamber 119. Gas that leaks into the endplate chamber from the pressure unit will be relatively hot and at a relatively high pressure. This gas will tend to be drawn from one unit into another, such as into the vacuum unit, thereby reducing efficiency. It may also be the case that the leak rate from the vacuum unit is high. This will lower the endplate chamber pressure, resulting in higher leak rates from the pressure unit. A vent hole 125, therefore, may be positioned in the shared endplate and used to keep the endplate chamber at an optimal pressure. This optimal pressure may be ambient pressure or some other pressure and/or may be from another source. This will prevent the shared fluid exchange between the compressors and/or will reduce the effects of the pressure of one compressor from having deleterious effects on the other compressor.

Figure 24:
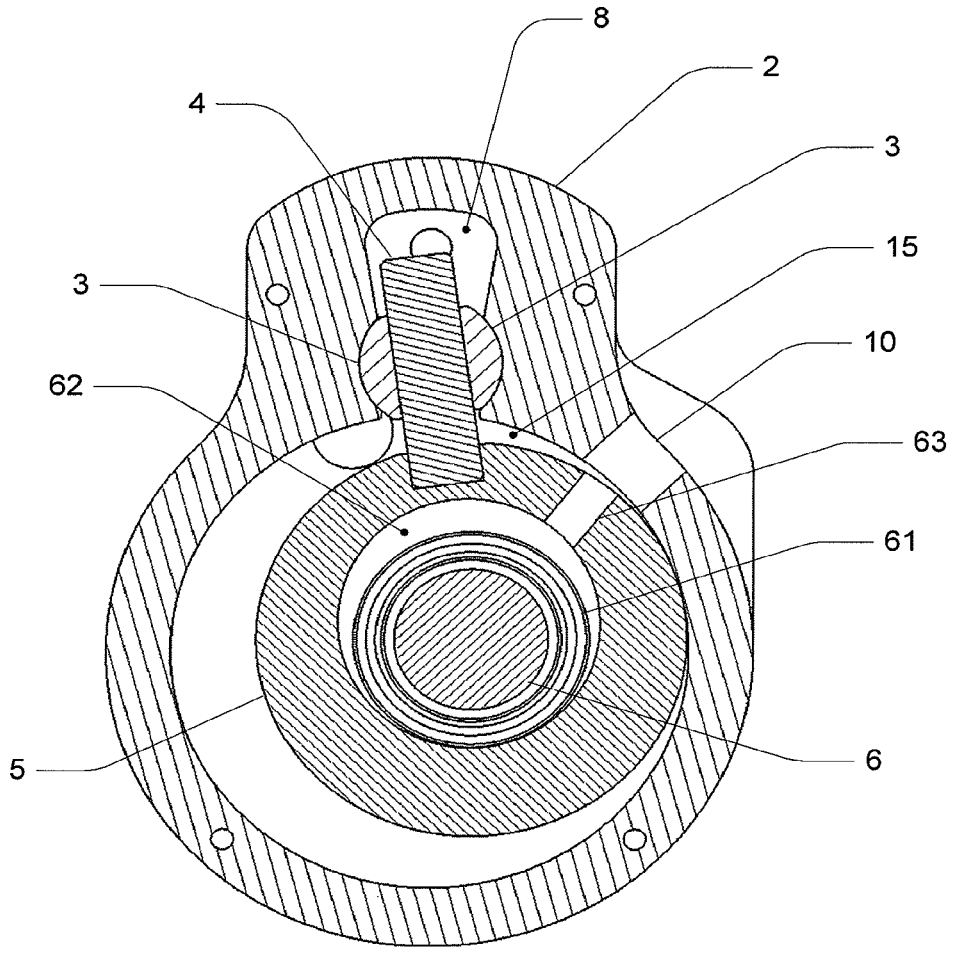
FIG. 24 is a cross-sectional view of a rotary compressor showing a piston showing a cut-out section.

FIG. 24 provides another embodiment of the present disclosure. A stator 2 is provided. The stator 2 is associated with a bushing 3, a vane 4 and a piston 5. Also depicted are a shaft 6 having a bearing 61 associated therewith. As can be seen, in this embodiment, stator 2 includes the inlet port 10. Further, in FIG. 24, a chamber 62 and passage 63 in the piston forms an accumulator volume. The accumulator volume may function in part to reduce inlet pulsation noise. For instance, as the piston moves past the suction port 10 in the stator 2, the incoming flow is abruptly slowed. This inlet flow stagnation can result in pressure waves that can typically cause objectionable noise. This configuration of the piston accumulation volume and stator containing inlet port can reduce the abrupt slowing of the flow and thereby reduce objectionable noise. The accumulator volume can also be formed by modifying the stator 2 in the inlet area or by allowing fluid communication between the vane chamber 8 and suction chamber 15. It is to be noted that since the piston is moving relative to the stator, the inlet port will be increasingly opened and closed in an equivalent manner to the manner described above.

Figure 25A:
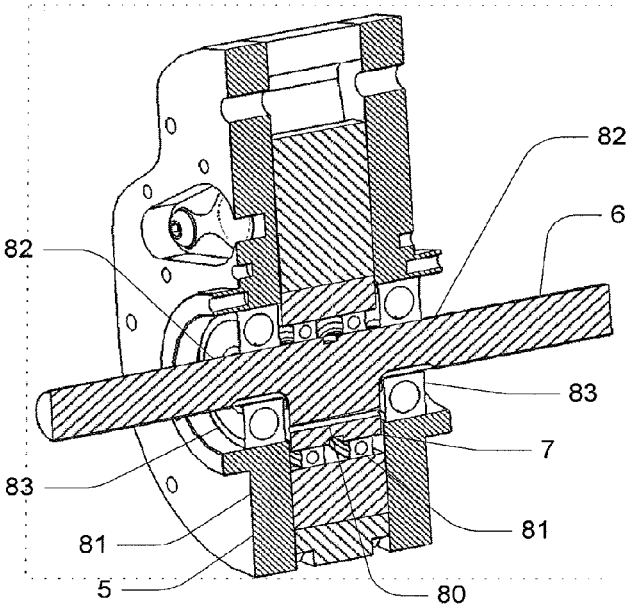
FIG. 25*a* is a cross-sectional perspective view of a rotary compressor showing geometries for equalizing pressures across a sealed bearing.
Figure 25B:
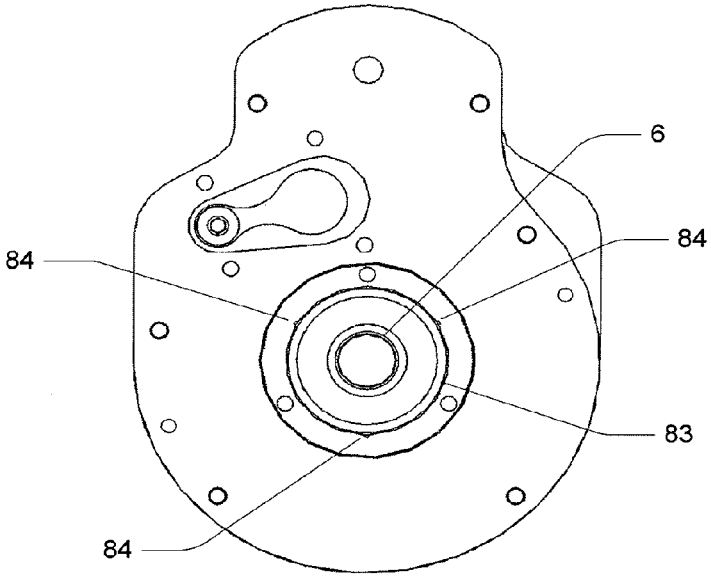
FIG. 25*b* is a geometry for venting a shaft bearing when mounted in an end plate.

FIGS. 25*a* and 25*b* are configurations for equalizing pressure on either side of a sealed bearing. As can be seen with respect to FIG. 25*a* a section view of a shaft 6 and a shaft eccentric 7 is presented. A vent hole 80 is shown in the shaft eccentric 7 and traversing laterally there through. As known in the art, sealed bearings often contain lubricant within the sealed volume surrounding the bearing balls or rollers. When mounted, such bearings can form part of an obstruction or pressure boundary in a structure. Since the seals of these bearings are not intended to maintain a pressure boundary, when a differential pressure is applied across the bearing, lubricant can leak out, which may contaminate the process fluid of the compressor.

Accordingly, in one method to prevent lubricant from leaking out, a path is created to give the fluid under the differential pressure an opportunity to equalize. In the case of radial bearings, for instance, as can be used in a rotary piston compressor of the disclosure, FIG. 25*a* shows a shaft 6 where bearings 81 for a piston 5 mount on the large diameter eccentric 7 and the equalization path passes entirely through the large diameter eccentric 7 of the shaft 6. In this manner, the pressure on both sides of interior diameter of the piston remains the same on both sides so as to centralize the axial motion of the piston, and the bearings are prevented from leaking.

FIG. 25*a* shows a shaft 6 and eccentric 7 where there is a notch 82 in the shaft so as to allow a flow path to be present around the inner ring of the bearings 83. Specifically, in this geometry, a small path is made along the diameter of the shaft where a sealed bearing mounts. The path may be small enough to not degrade the fit between the inner race of the bearing and the shaft, yet large enough to allow pressure to equalize across the bearing at a satisfactory rate and thereby achieving the same benefits as described above.

FIG. 25*b* shows a shaft 6, having a shaft bearing 83 (as in 25*a*), and an endplate, having one or more, e.g., 3, cutouts 84 so that fluid can flow there through around the outer ring. Specifically, in this bearing mounting configuration, the outer race of a sealed bearing is mounted in an end plate or similar structure, and one or more small paths are made along the mounting diameter for the bearing in the end plate. The small paths need not intersect with the mounting diameter, but may alternately be proximate to the mounting diameter. Again the path may be small enough to not degrade the fit between the race and the end plate, but large enough to allow pressure to equalize across the bearing at a satisfactory rate.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A system comprising:

a first inlet configured to receive fluid that is to be compressed;

a first piston configured to rotate around a first eccentric of a shaft in an orbital fashion in order to compress the fluid, the first piston being coated with an abradable coating, the fluid being used as a lubricant for lubricating the first piston, the use of the fluid for lubricating and the abradable coating eliminating a need of another lubricant for lubricating the first piston;

a first outlet configured to discharge the compressed fluid;

a second inlet configured to receive, from a separator device, one or more exhaust gases that have been separated from the fluid, the one or more exhaust gases being a subset of gases forming the fluid;

a second piston configured to rotate around a second eccentric of the shaft in the orbital fashion, axial surfaces of the second piston being parallel to axial surfaces of the first piston, the second piston being coated with the abradable coating, the one or more exhaust gases being used as a lubricant for lubricating the second piston, the use of the one or more exhaust gases for lubricating and the abradable coating of the second piston eliminating a need of another lubricant for lubricating the second piston; and a second outlet configured to exhaust the gases.

2. The system of claim 1, further comprising:

a first vane connected to the first piston;

a first set of bushings slidingly connected to the first vane; and a first stator configured to enclose the first piston and the first vane.

3. The system of claim 2, wherein each bushing of the first set of bushings has a flat surface in contact with a surface of the first vane.

4. The system of claim 2, wherein the first stator encloses a chamber that includes at least a vane chamber and a bore chamber, the bore chamber comprising a compression chamber and a suction chamber that is sealed from the compression chamber by the first vane and the first set of bushings.

5. The system of claim 4, wherein the compression chamber and the suction chamber are interchanged during the rotation of the first piston such that the compression chamber performs suction and the suction chamber performs compression.

6. The system of claim 4, wherein the first vane comprises a cutout vane relief, the vane relief allowing pressure of air within the vane chamber to equalize with pressure in the suction chamber in order to minimize wear of the first set of bushings, the minimized wear of the first set of bushings eliminating a need of another lubricant for lubricating the first set of bushings.

7. The system of claim 2, further comprising:

a second vane connected to the second piston;

a second set of bushings slidingly connected to the second vane; and a second stator configured to enclose the second piston and the second vane, the first stator and the second stator being a single machined unit.

8. The system of claim 2, wherein an outer surface of the first piston comprises dimples that cause a rise of pressure of the fluid within the dimples, the rise of the pressure pushing the first piston away from an inner surface of the first stator so as to minimize contact between the first piston and the first stator, the minimized contact eliminating the need of the another lubricant for providing lubrication between the first piston and the first stator.

9. The system of claim 2, wherein the first vane comprises a recess that is in fluid communication with a recess within the first piston, a pressure of fluid in the recess within the first piston preventing the recess from contacting the first stator, the prevention of contact between the first piston and the first stator eliminating the need of another lubricant for providing lubrication between the first piston and the first stator.

10. The system of claim 2, wherein the first piston comprises recesses intersecting an outside diameter of the first piston, the recesses intersecting the outside diameter of the first piston being pressurized such that pressure of the pressurized recesses prevents a contact between the first piston and the first stator, the prevention of contact between the first piston and the first stator eliminating the need of another lubricant for providing lubrication between the first piston and the first stator.

11. The system of claim 1, further comprising:

a suction endplate that incorporates the first inlet; and a discharge endplate that incorporates the first outlet.

12. The system of claim 11, wherein at least one of the first stator, the suction endplate and the discharge endplate are coated with the abradable coating.

13. The system of claim 12, wherein the abradable coating minimizes friction between the first piston and the first stator, the minimized friction between the first piston and the first stator eliminating the need of another lubricant for lubricating the first piston.

14. The system of claim 1, wherein the abradable coating comprises a polymer based coating.

15. The system of claim 1, wherein the fluid that is to be compressed is ambient air, the ambient air being received at the first inlet from an ambient air collecting source.

16. The system of claim 15, wherein the compressed fluid is pressurized ambient air, the pressurized air going from the first outlet to a separator device.

17. The system of claim 16, wherein the separator device is a vacuum-pressure-swing-adsorption (VPSA) device.

18. The system of claim 16, wherein the separator device is a vacuum-swing-adsorption (VSA) device.

19. A method comprising:

receiving ambient air at a first inlet of a rotary compressor powered by a motor;

rotating a first piston of the rotary compressor around a first eccentric of a shaft in an orbital motion to compress the ambient air into compressed gas;

sending, at a first outlet of the rotary compressor, the compressed gas to a separator device configured to separate the compressed gas into a first gas and other gases, the rotary compressor being lubricated by the ambient air and the compressed gas while not requiring another lubricant;

receiving, at a second inlet of a vacuum pump powered by the motor, the other gases from the separator device, the vacuum pump comprising a second piston configured to rotate around a second eccentric of the shaft in the orbital motion, the second piston being radially parallel to the first piston; and exhausting the other gases at a second outlet of the vacuum pump, the vacuum pump being lubricated by the other gases while not requiring another lubricant.

20. The method of claim 19, wherein the first gas is oxygen.

* * * * *